US008622139B2

(12) United States Patent
Herbel et al.

(10) Patent No.: US 8,622,139 B2
(45) Date of Patent: Jan. 7, 2014

(54) EMERGENCY SUBSEA WELLHEAD CLOSURE DEVICES

(75) Inventors: Ryan R. Herbel, Houston, TX (US); Rick C. Hunter, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 480 days.

(21) Appl. No.: 12/968,684

(22) Filed: Dec. 15, 2010

(65) Prior Publication Data

US 2012/0152561 A1 Jun. 21, 2012

(51) Int. Cl.
*E21B 34/04* (2006.01)
*E21B 33/064* (2006.01)

(52) U.S. Cl.
USPC ..... 166/363; 166/347; 166/361; 166/368; 166/373; 166/86.1; 137/315.02; 251/1.1

(58) Field of Classification Search
USPC ..... 166/360, 338, 344, 345, 347, 351, 361, 166/363, 364, 368, 297, 298, 373, 55, 86.1; 137/315.02; 251/1.1–1.3; 285/123.1, 285/123.14
See application file for complete search history.

(56) References Cited

U.S. PATENT DOCUMENTS 1,851,894 A * 3/1932 Clough ..... 166/55
1,949,672 A * 3/1934 Barrier ..... 166/55
2,034,698 A 3/1936 Hild
2,840,166 A * 6/1958 Eckel et al. ..... 166/55
3,277,964 A * 10/1966 Houpeurt et al. ..... 166/285
3,647,000 A * 3/1972 Rowley et al. ..... 166/285
3,738,424 A * 6/1973 Osmun et al. ..... 166/298
3,740,017 A * 6/1973 Pogonowski ..... 251/5
3,789,689 A * 2/1974 Mace ..... 72/407
3,926,256 A * 12/1975 McCall ..... 166/285
4,147,221 A * 4/1979 Ilfrey et al. ..... 175/7
4,163,477 A * 8/1979 Johnson et al. ..... 166/363
4,369,845 A * 1/1983 Henson et al. ..... 166/298
4,417,625 A * 11/1983 Henson et al. ..... 166/387
5,207,779 A * 5/1993 Chaplinski ..... 169/43

(Continued)

FOREIGN PATENT DOCUMENTS

BE 1004846 A6 2/1993
GB 2254634 A 10/1992
WO 2011150233 A1 12/2011

OTHER PUBLICATIONS

GB Search Report dated Feb. 20, 2012 from corresponding Application No. GB112125.5.

(Continued)

*Primary Examiner* — Matthew Buck
(74) *Attorney, Agent, or Firm* — Bracewell & Giuliani LLP

(57) ABSTRACT

Wellhead-based systems, apparatus, and methods for controlling a well are provided. During a failure of an emergency system such as a blowout provider, a wellhead based emergency control apparatus according to an embodiment of the invention can be employed to control the well. A casing strings compression assembly can radially compress each of the casing strings and/or drilling pipe extending through the wellhead housing to restrict or stop well fluid passage. A casing strings penetrator of an emergency well fluid diversion assembly can also or alternatively be employed to form an aperture in the casing strings. A diverter, integral with or connected to the penetrator, is extended through an aperture in a side of the wellhead housing and one or more of the apertures cut by the penetrator to divert well fluid from within the wellhead housing through a passageway in the diverter and to an external conduit.

26 Claims, 5 Drawing Sheets

(56) References Cited

U.S. PATENT DOCUMENTS

| | | | | |
|---|---|---|---|---|
| 5,280,823 | A * | 1/1994 | Chabot | 166/55 |
| 6,125,928 | A * | 10/2000 | Ninivaara et al. | 166/55 |
| 6,408,944 | B1 * | 6/2002 | Niinivaara et al. | 166/298 |
| 7,300,033 | B1 | 11/2007 | Whitby | |
| 7,647,973 | B2 | 1/2010 | Minassian | |
| 7,650,944 | B1 * | 1/2010 | Boyle | 166/344 |
| 2009/0211761 | A1 | 8/2009 | Broussard | |

OTHER PUBLICATIONS

GB Search Report dated Apr. 3, 2012 from corresponding Application No. GB1121225.5.

* cited by examiner

EMERGENCY SUBSEA WELLHEAD CLOSURE DEVICES

BACKGROUND OF THE INVENTION

1. Field of the Invention

The present invention relates to riser management systems. More particularly, the present invention relates to a system, program product, and related methods for controlling a well during an emergency.

2. Description of Related Art

A problem presented by offshore hydrocarbon drilling and producing operations conducted from a floating platform or vessel is the need to establish a sealed fluid pathway between each borehole or well at the ocean floor and the work deck of the vessel at the ocean surface. This sealed fluid pathway is typically provided by a drilling riser system. Drilling risers, which are utilized for offshore drilling, extend from the drilling rig to a blowout preventer (BOP) which is directly or indirectly connected to an upper portion of a subsea wellhead. A typical marine drilling riser permits passage of drill pipe which is used for pumping lubricating mud down the well during drilling operations, return of drilling mud that has been pumped through the drill pipe into the main tube of the riser, and any associated drill cuttings, and provides a connection of the drilling vessel to the well above the subsea BOP stack. Similarly, production risers extend from and provide communication between the subsea wellhead system and the floating vessel.

The BOP, often referred to as a BOP stack, is a specialized valve or set of valves used to control and monitor the subsea well. The BOP stack generally includes two categories of blowout preventers: ram and annular. The ram-type BOP typically uses a pair of opposing steel rams which can extend radially to either block or open a fluid passageway extending through the BOP stack. The ram BOP includes pipe rams, blind rams, shear rams, and blind sheer rams. Pipe rams close, around the pipe to restrict flow in the annulus between the outside of the drill pipe and inner bore of the BOP stack when a drilling pipe is extending, through the bore of the BOP stack. Blind rams, which have no openings for tubing, close off the bore completely when no drilling pipes extend through the BOP stack by pressing against each other to form a seal. Shear rams and blind shear rams cut through the drilling pipe with hardened steel shears. The annular BOP functions similar to a sphincter, The different preventers can have different closure diameters to accommodate for either the existence of drilling pipe or different diameters of drilling pipe. The BOP stack also includes a number of choke and kill lines that extend alongside the riser and enter the interior of BOP at different points between BOP elements which can be used to shut down the subsea well.

The drilling riser can be disconnected from the well above the 130P stack, allowing the drilling vessel to retrieve the riser and temporary move from the drill site should the need arise (i.e., during a hurricane event, or a malfunction). Having remained atop the wellhead, when functioning properly the BOP stack provides for containment of a live well while the vessel is not on location. Upon return, the vessel can deploy the riser, reconnect to the BOP stack, and reestablish hydrocarbon communication with the well, The marine drilling riser also permits control of the well during an emergency through use of the BOP stack, Emergencies requiring activation of components of the BOP stack are typically associated with drilling through a zone with geological fluid pressure that is substantially higher than that which the drilling mud can contain. During such events, one or more of the different types of preventer of the BOP stack is hydraulically functioned to close off or restrict the flow of well fluid flowing through the BOP stack. Well control is then re-established by pumping an appropriate density mud through the kill line and eventually circulating it back to the surface via the choke line.

Recent newsworthy events, however, have highlighted that BOPs can have reliability issues. In a recent event, failure of the BOP to activate resulted in destruction of the drilling, rig and substantial environmental damage due to the failure of the BOP stack to stop well fluid flow into the surrounding ocean. Accordingly, recognized by the inventors is that there needs to be a two fault system in place and a wellhead based emergency control apparatus can advantageously provide the necessary fault protection by providing an independent, safe guard system. Also recognized by the inventors is that currently existing well control systems do not provide for a. wellhead based method for shutting, off a well. Recognized by the inventors, therefore, is the need for a wellhead-based systems, apparatus, and methods of controlling the flow of well fluid in an emergency that is independent of the BOP. Specifically, recognized by the inventors is the need for systems, apparatus, and methods which can include an emergency well fluid shutoff assembly positioned separately from the BOP stack which can radially compress casing strings and/or drilling pipe extending through the subsea wellhead without shearing in order to obtain a substantial reduction in the flow of well fluid through the subsea wellhead. Also recognized by the inventors is the need for systems, apparatus, and methods which include an emergency well fluid diversion assembly to divert well fluid from within the wellhead housing to an external conduit to thereby release fluid pressure of well fluid flowing within the wellhead housing in a. controlled manner.

SUMMARY OF THE INVENTION

In view of the foregoing, various embodiments of the present invention advantageously provide systems, apparatus, and methods of controlling the flow of well fluid in an emergency that is independent of the BOP. Various embodiments of the present invention include systems, apparatus, and methods which can include an emergency well fluid shutoff assembly positioned separately from the BOP stack which can radially compress casing strings and/or drilling pipe extending through the subsea wellhead without shearing in order to obtain a substantial reduction in the flow of well fluid through the subsea wellhead. Various embodiments of the present invention also include systems, apparatus, and methods Which include an emergency well fluid diversion assembly to divert well fluid from within the wellhead housing to an external conduit to thereby release fluid pressure of well fluid flowing within the wellhead housing in a controlled manner Specifically, an embodiment of the present invention provides a wellhead-based control apparatus to control a well. The apparatus can include an emergency well fluid shutoff assembly connected to or integral with a wellhead housing. The emergency well shutoff assembly can include a casing strings compression assembly positioned to radially compress each of it plurality of casing, strings extending, through a bore of the wellhead housing, and a casing strings compression actuator operably coupled to the casing strings compression assembly to actuate the casing strings compression assembly. According to an exemplary embodiment of the present invention, the casing strings compression assembly includes a pair of opposing compression rams positioned to extend radially toward a center of the bore of the wellhead housing to apply a compressing force at a same coaxial location to each of the plurality of casing strings.

Each of the pair of opposing compression rams can include a hydraulic piston connected to a portion of the wellhead housing to apply the compressing force. As such, the casing strings compression actuator can include a hydraulic source including various components such as, for example, a hydraulic accumulator storing pressurized hydraulic fluid, a hydraulic pump assembly having a hydraulic pump, a motor positioned, to drive the hydraulic pump, and a hydraulic fluid reservoir. Alternatively, each of the pair of opposing compression rams can include a linear actuator connected to a portion of the wellhead housing that when rotated extends casing string engagement surfaces of the compression rams toward a center of the bore of the wellhead housing to apply the compressing force to the plurality of casing strings. As such, the casing strings compression actuator can include one or more electric motors positioned to rotate the linear actuators and an electrical power source. A remote activation controller operably connected to or integral with the emergency well fluid shutoff assembly is configured to receive remote activation commands and to provide a remote activation signal to the casing strings compression actuator to cause actuation of the casing strings compression assembly.

According to an exemplary embodiment of the present invention, the wellhead based control apparatus separately or additionally includes an emergency well fluid diversion assembly connected to or integral with the wellhead housing. The emergency well fluid diversion assembly can include a casing strings penetrator positioned to form an aperture in each of the plurality of casing strings at approximately a same coaxial location, and a well fluid diverter positioned to extend through the apertures in each of the casing strings to divert well fluid from within the wellhead housing to an external conduit to thereby release fluid pressure of well fluid flowing within the wellhead housing in a controlled manner.

The penetrator can be implemented according to various means such as, for example, in the form of a cutting blade assembly positioned to cut an aperture through the wellhead housing and the plurality of casing strings, an electrical discharge cutting assembly positioned to cut an aperture through the wellhead housing and the plurality of casing strings, a chemical milling assembly positioned to cut an aperture through the wellhead housing and the plurality of casing strings, an explosive discharge cutting assembly including a explosive charge operably connected to a cutting torpedo to cut an aperture through the wellhead housing and the plurality of Casing strings, just to name a few.

In an exemplary configuration, the diverter includes a maw body, a passageway extending through portions of the main body along a main axis thereof to channel well fluid from within the wellhead housing, and a well fluid collection aperture extending through at least a portion of the diverter and connecting to the passageway to provide a fluid channel to the passageway. The well fluid collection aperture of the diverter can be in the form of a downward facing recess that does not extend through the main body of the diverter so that when the diverter is operably positioned and sealed within the wellhead housing, the well fluid collection aperture channels well fluid into the passageway in the main body to divert well fluid from within the wellhead housing to an external conduit. Correspondingly, outer surface portions of the diverter can be shaped and material-wise configured to extend through and engage inner surface portions of an aperture in the wellhead housing to form a fluid-tight seal. Also or alternatively, inner surface portions of one or more of the apertures extending through the casing strings can be sized to form a sealing relationship with the outer surface portions of the diverter and the inner surface portions of the one or more of the apertures. A remote activation controller operably connected to or integral with the emergency well fluid diversion assembly is configured to receive remote activation commands and to provide a remote activation signal to the casing strings penetrator to cause the formation of the aperture in each of the plurality of casing strings, and/or the well fluid diverter to extend through the aperture in each of the plurality of casing strings to divert well fluid from within the wellhead housing to an external conduit.

Embodiments of the present invention also include methods to control a well. For example, a method according to an embodiment of the present invention can include employing a casing strings compression assembly of an emergency well fluid shutoff assembly to radially compress each of the plurality of casing strings extending through portions of the wellhead to restrict well fluid passage. The method can also include employing a casing strings penetrator of an emergency well fluid diversion assembly to form an aperture in at least one of a plurality of casing strings and extending a well fluid diverter through an aperture in a side of the wellhead housing and one or more of the apertures cut by the penetrator to divert well fluid from within the wellhead housing to an external conduit. According to an exemplary embodiment of the method, insertion of the diverter can be accomplished by initially inserting portions of the diverter with the upper and lower surfaces of the inserted portions of the diverter oriented at least partially transverse to a direction of flow of well fluid within the wellhead housing to thereby allow well fluid to bypass the diverter, and rotating the diverter to orient the downward facing aperture in a direction of the well fluid, within the wellhead housing to divert well fluid from within the wellhead housing to the passageway in the diverter and to an external conduit. The step of rotating the diverter can include first sealingly engaging outer surface portions of the diverter with inner surfiice portions of the aperture in at least one of the plurality of casing strings, and orienting the downward facing aperture in a direction of the well fluid within the wellhead housing to divert well fluid from within the wellhead housing to the passageway in the diverter and to an external conduit, Various embodiments of the present invention advantageously provide a wellhead based well control apparatus attached to or integral with a wellhead system to control the well. The well control apparatus can advantageously include both an emergency well fluid shutoff assembly and an emergency well fluid diversion assembly. The emergency well fluid shutoff assembly can be actuated to stop or restrict the flow of oil and gas from a subsea well whereby the stoppage or restriction can be accomplished by compression of the casing strings, such as 22", 13⅝" and for 10¾" casings, so that little or no flow area remains. The restriction can be provided, by mechanically collapsing the well casing, strings, for example, by mechanically applied forces or explosively applied forces. Collapsing forces can be achieved through piston style rams driven by pressure, driven by electro-mechanical motors, phase change material systems, or by direct high pressure as from an explosive apparatus. Other means of collapsing the casing are nevertheless within the scope of the present invention. The emergency well fluid diversion assembly can be actuated to penetrate the wellhead housing and/or casing and/or drilling string in order to control the flow of oil and gas from the subsea well Advantageously, a penetrator can be employed to penetrate the well by drilling or by perforation through the casing strings so that the flowing string can be restricted or diverted. A diverter, separate from or integral with the penetrator, can act to create a new flow path emanating from one or more of the penetrated well casings. The penetration of the wellbore may be performed by various means such as, for example, boring, chemical milling, electrical discharge machining, or via perforation using explosive charges. Once the bore is penetrated, a physical barrier forming a diverter can be introduced through the penetration to divert the flow from the wellbore. Advantageously, the diverter, connected to or integral with the penetrator can advantageously have a bore for conducting the flow of fluids once the penetrator/diverter is in place. Advantageously, the apparatus can also include a control system or systems to control both portions of the well fluid shutoff assembly and portions of the well fluid diversion assembly that, as a minimum, can be actuated remotely, independent of platform control system or personnel, such that the control system or systems is isolated from known failure modes such as a riser failure or well blow out/rig destruction event.

BRIEF DESCRIPTION OF THE DRAWINGS

So that the manner in which the features and advantages of the invention, as well as others which will become apparent, may be understood in more detail, a more particular description of the invention briefly summarized above may be had by reference to the embodiments thereof which are illustrated in the appended drawings, which form a part of this specification. It is to be noted, however, that the drawings illustrate only various embodiments of the invention and are therefore not to be considered limiting of the invention's scope as it may include other effective embodiments as well.

DETAILED DESCRIPTION

The present invention will now be described more fully hereinafter with reference to the accompanying drawings, which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art.

FIGS. 1-9 illustrate various embodiments of an apparatus 30 and methods to control a subsea well system 31 Various embodiments of the present invention advantageously provide a back-up to the traditional BOP stack used for the shutting off or diverting the flow fluid from a subsea well in the case of a blow out, or for permanent well abandonment. If a blowout occurs, this new wellhead emergency control apparatus 30 can be actuated remotely, independent of platform control systems or personnel. Remote actuation can include both ROV (remotely operated vehicle) intervention, or by an electrical activation means or hydraulic actuated means. Current safeguards to well control are symbiotic, in that they are not independent. The current safeguards only work if the systems perform as designed. This is because the primary controls for the standard BOP system are located, on the platform, such safeguard system is designed to protect, so that if one fails, so might the other. Advantageously, embodiments of the apparatus 30 can provide an independent safe guard system which provides the second of a two fault system in the form of a wellhead based emergency control apparatus 30. Where currently existing well control systems do not provide for as wellhead based method for shutting off a well., various methods of well shut-in according to embodiments of the present invention advantageously provide such capability at a location in the production flow that precedes the standard BOP. The location at the wellhead also can be beneficial because it is less likely that there would be damage to the apparatus 30 or otherwise inadvertently taken offline when a riser drop occurs. A riser drop can be caused by a number of events including fatigue, drive-off, blow-out, human error, etc. The location of the intervention for the wellhead shut-off apparatus 30 can beneficially be well protected or even submudline to protect it from mechanical damage.

Figure 1:
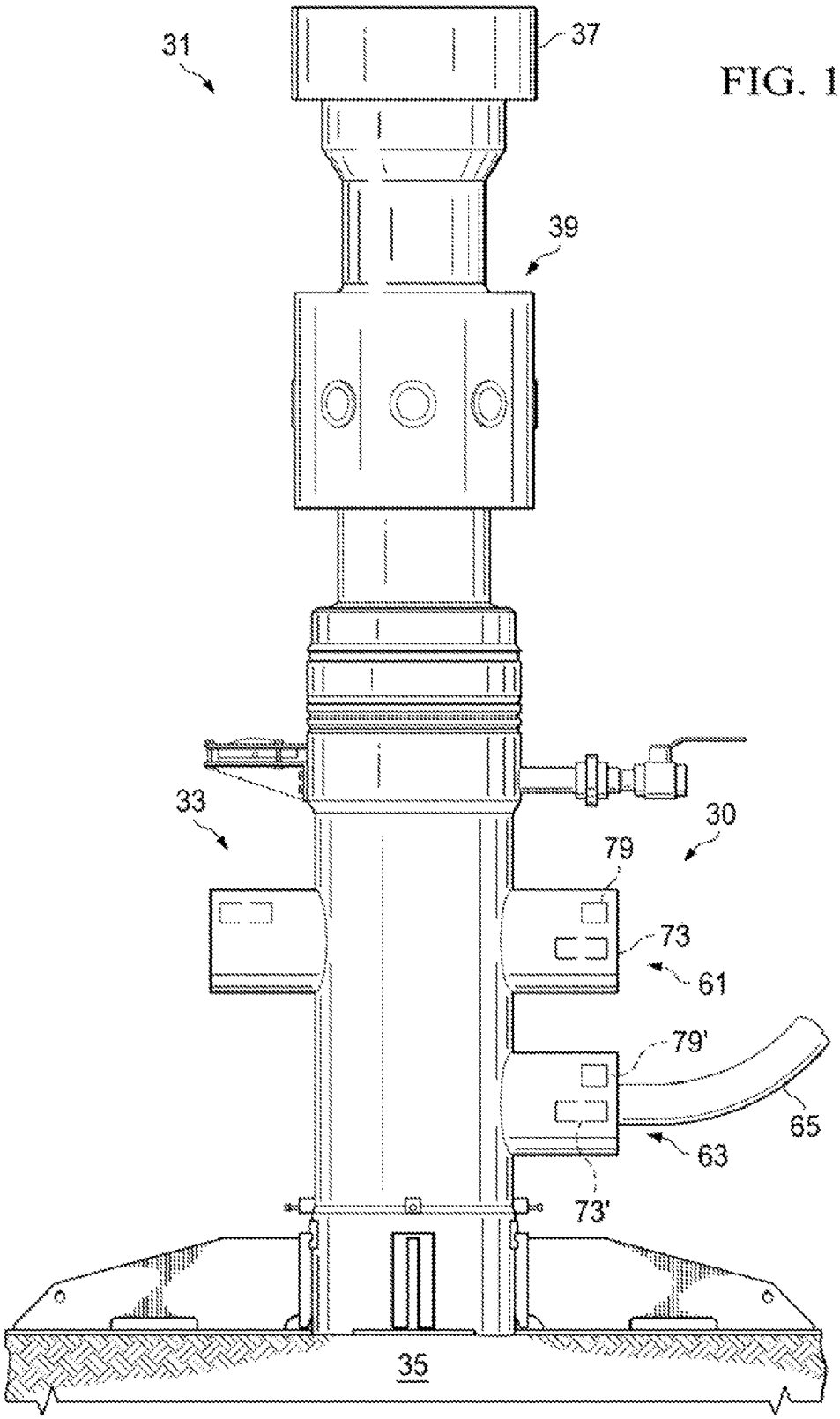
FIG. 1 is a combination schematic block diagram and environmental view of a wellhead-based control apparatus to control a well according to an embodiment of the present invention.
Figure 2:
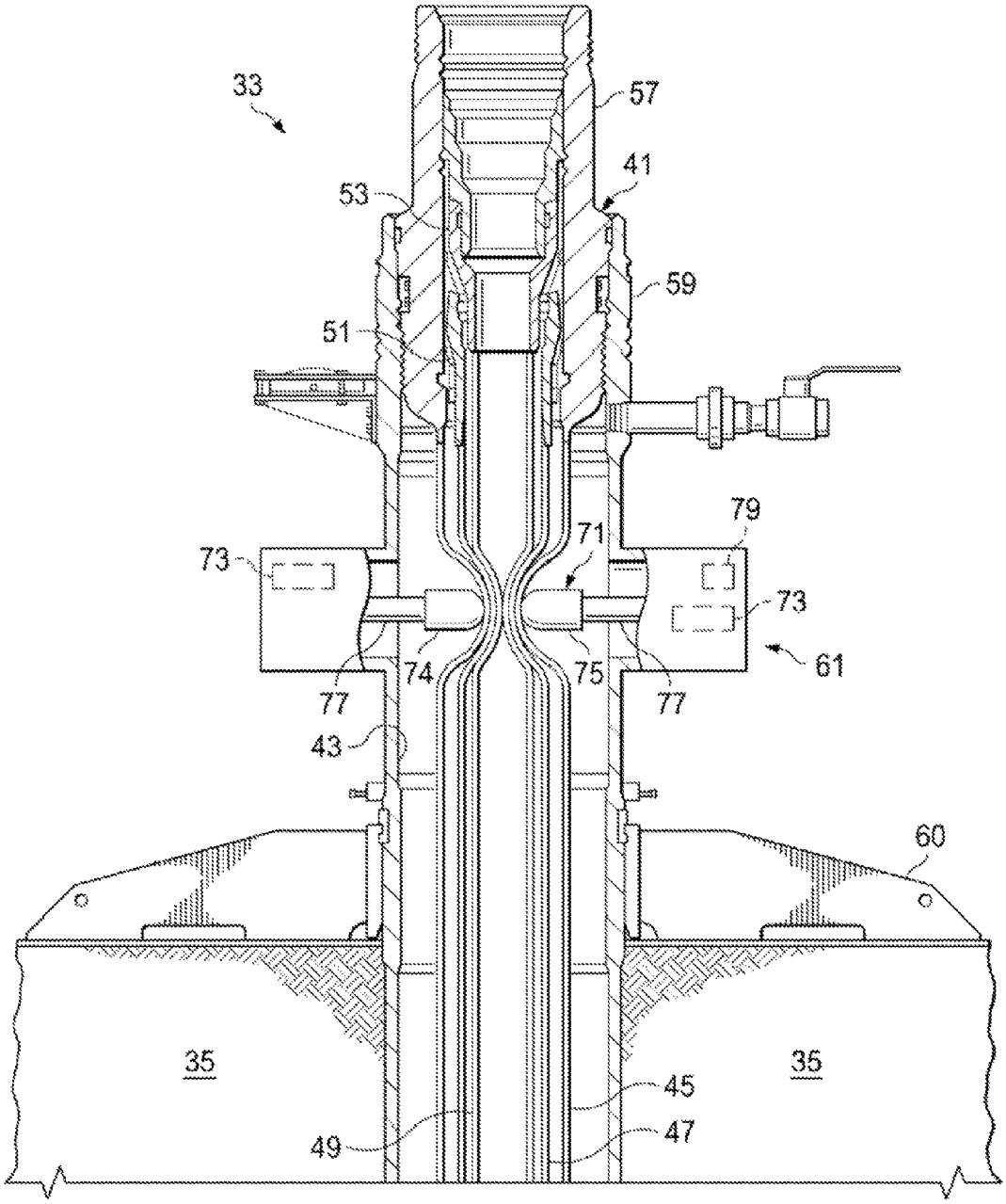
FIG. 2 is a combination sectional, perspective, and environmental view of a portion of an emergency well fluid shutoff assembly according to an embodiment of the present invention.
Figure 3:
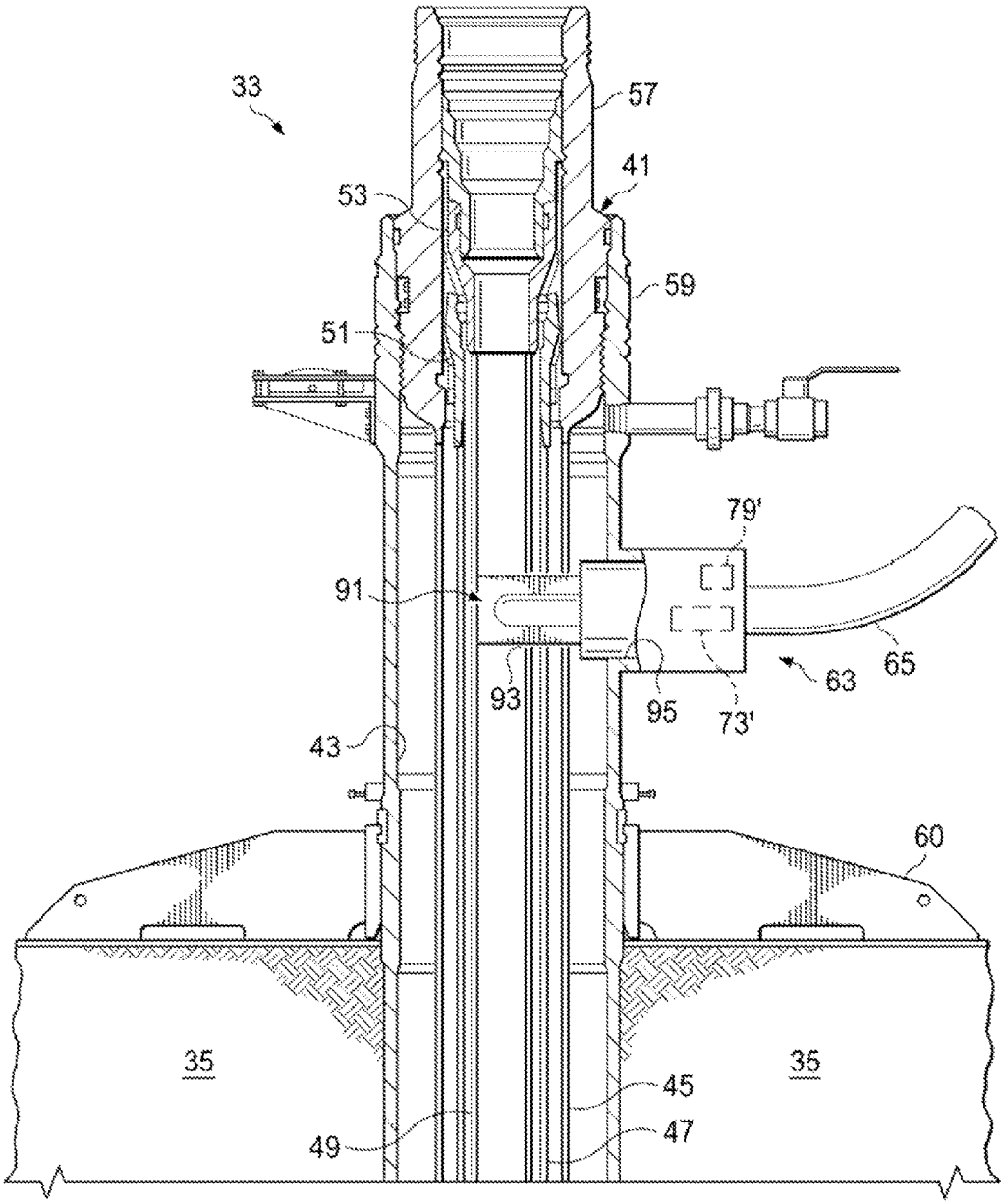
FIG. 3 is a combination sectional, perspective, and environmental view of a portion of an emergency well fluid diversion assembly according to an embodiment of the present invention.

Referring to FIGS. 1-3, a subsea well system 31 can include a subsea wellhead (system) 33 landed atop a reservoir floor 35. Connected to the top of the wellhead 33 is a blowout preventer 37 positioned to control well fluid exiting the subsea wellhead 33. In the illustrated configuration, a connector 39 is located between the subsea wellhead 33 and a blowout preventer 37. As perhaps best illustrated in FIGS. 2 and 3, the wellhead 33 includes a high-pressure housing 41 having, an central bore 43 typically containing 22", 13⅝" and/or 10¾" casing strings 45, 47, 49, extending through the central bore 43 along with appropriate hardware to include, for example, 13⅝" and/or 10¾" casing hangers 51, 53. The high-pressure housing 41 typically welded to 20" or 22" pipe 45, is landed in the low pressure housing 59 which is typically welded to 30" or larger pipe which extends to the reservoir floor 35.

FIG. 1 illustrates an example of a wellhead-based control apparatus 30 to control a well system 31, which can include both an emergency well fluid shutoff assembly 61 (see also, FIG. 2) connected to or integral with the housing 41 of wellhead 33 and configured to restrict or stop the flow of fluid through the wellhead 33, and an emergency well fluid diversion assembly 63 (see also, FIG. 3) connected to or integral with the housing 41 of wellhead 33 and configured to divert well fluid through an external conduit 65 to thereby release fluid pressure of well fluid flowing within the wellhead housing 41 in a controlled manner, both described, in more detail below. Note, according to a preferred configuration, the emergency well fluid shutoff assembly 61 and the emergency well fluid diversion assembly 63 are positioned below the casing hangers 51, 53 and any adjacent equipment such as, for example, a slope indicator or ball valve. Further, although shown above the mudmat 60, one or both of the emergency well fluid shutoff assembly 61 and the emergency well fluid diversion assembly 63 can be positioned below the mudmat 60 to protect the assemblies 61, 63 from physical damage during a catastrophic event As shown in more detail in FIG. 2, the emergency well shutoff assembly 61 can include a casing strings compression assembly 71 positioned to radially compress each of casing strings 45, 47, 49 extending through the bore 43 of the wellhead housing 41, and a casing strings compression actuator 73 operably coupled to the casing strings compression assembly 71 to actuate the casing strings compression assembly 71. The casing strings compression assembly 71 includes a pair of opposing compression rams 74, 75, positioned to extend. radially toward a center of the bore 43 of the wellhead housing 41 to apply a compressing force to each of the casing strings 45, 47, 49. Note, each of the casing strings 45, 47, 49, have a different diameter than each other of the plurality of casing strings 45, 47, 49. As such, in the exemplary configuration, when applied radially, compression is at approximately a same coaxial location for each of the of casing strings 45, 47, 49.

According to an exemplary embodiment of the present invention, each of the pair of opposing compression rams 74, 75, can include a hydraulic or electric piston 77 connected to a portion of the wellhead housing 41 to apply the compressing force. As such, when implemented hydraulically, the casing strings compression actuator 73 can include a hydraulic source including various components such as, for example, a hydraulic accumulator storing pressurized hydraulic fluid, a hydraulic pump assembly having a hydraulic pump, a motor positioned to drive the hydraulic pump, and a hydraulic fluid reservoir as known and understood by one of ordinary skill in the art. Alternatively, piston 77 can be in the form of a linear actuator connected to a portion of the wellhead housing 41 that when rotated extends casing, string engagement surfaces of the compression rams 74, 75, toward a center of the bore 43 of the wellhead housing 41 to apply the compressing force to the casing strings 45, 47, 49. As such, when implemented electrically, the casing strings compression actuator 73 can include one or more electric motors positioned to rotate the linear actuators and an electrical power source as known and understood by one of ordinary skill in the art. A remote activation controller 79 operably connected to or integral with the emergency well fluid shutoff assembly 61 is configured to receive remote activation commands and to provide a remote activation signal to the casing strings compression actuator 73 to cause actuation of the casing strings compression assembly 71.

As shown in more detail in FIGS. 3-6, the emergency well fluid diversion assembly 63 can include a casing strings penetrator 91 positioned to form an aperture 93 in each of the casing strings 45. 47, 49, at approximately a same coaxial location, and if not already in existence, and aperture 95 in a side wall of the wellhead housing 41, and can include a well fluid diverter 97 separate from or integral with the casing strings penetrator 91 and having portions configured and positioned to extend through an aperture 95 in the wellhead housing 41 and one or more of the apertures 93 in the casing strings 45, 47, 49, to divert well fluid from within the wellhead housing 41 to the external conduit 65 to thereby release fluid pressure of well fluid flowing within the wellhead housing 41 in a controlled manner. Note, according to a preferred configuration, as part of an installation package, an access aperture 95 is preformed or cut during retrofit to accommodate the well fluid diversion assembly 63.

The penetrator 91 can be implemented according to various means as known understood by one of ordinary skill in the art such as, for example, in the form of a cutting blade assembly 99 (see, e.g., FIG. 7) having various shapes, an electrical discharge cutting assembly 100 (see, e.g., FIG. 8) also having various shapes, a chemical milling assembly (not shown), and/or an explosive discharge cutting assembly including a explosive charge (not shown) operably connected to a cutting, torpedo, each positioned to cut the apertures 93 through the casing strings 45, 47, 49, and/or aperture 95 in the wellhead housing 41 to cut an aperture through the wellhead housing and the plurality of casing strings. Other cutting means as known to one of ordinary skill in the art are within the scope of the present invention. Further, actuator 73' can be in various forms depending upon the implementation of penetrator 91. For example, if implemented form of a cutting blade assembly, chemical milling assembly, or electrical discharge cutting assembly, the actuator can include a motor and power supply for rotating the cutting surface. If in the form of an explosive discharge cutting, assembly, the actuator 73' can include a detonator, etc.

Figure 4:
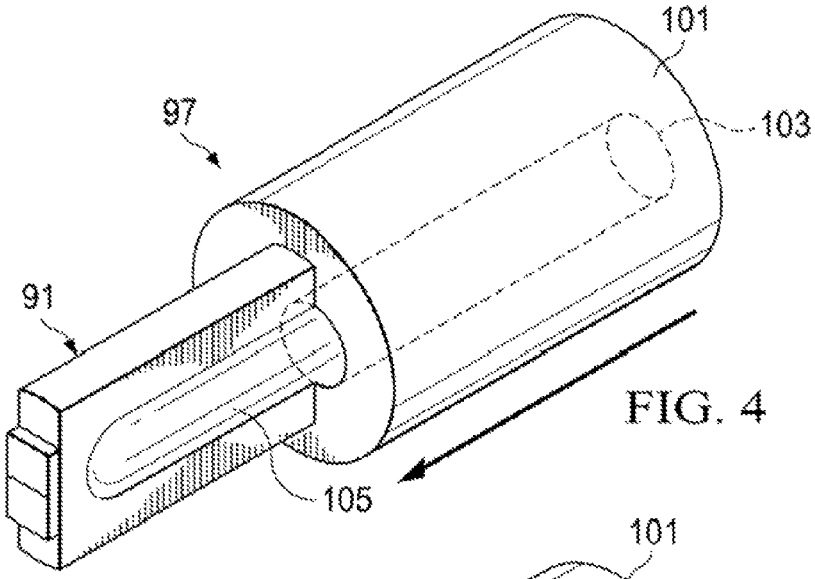
FIG. 4 is a perspective view of a diverter inserted into a subsea wellhead housing prior to rotation of the diverter according to an embodiment of the present invention.
Figure 5:
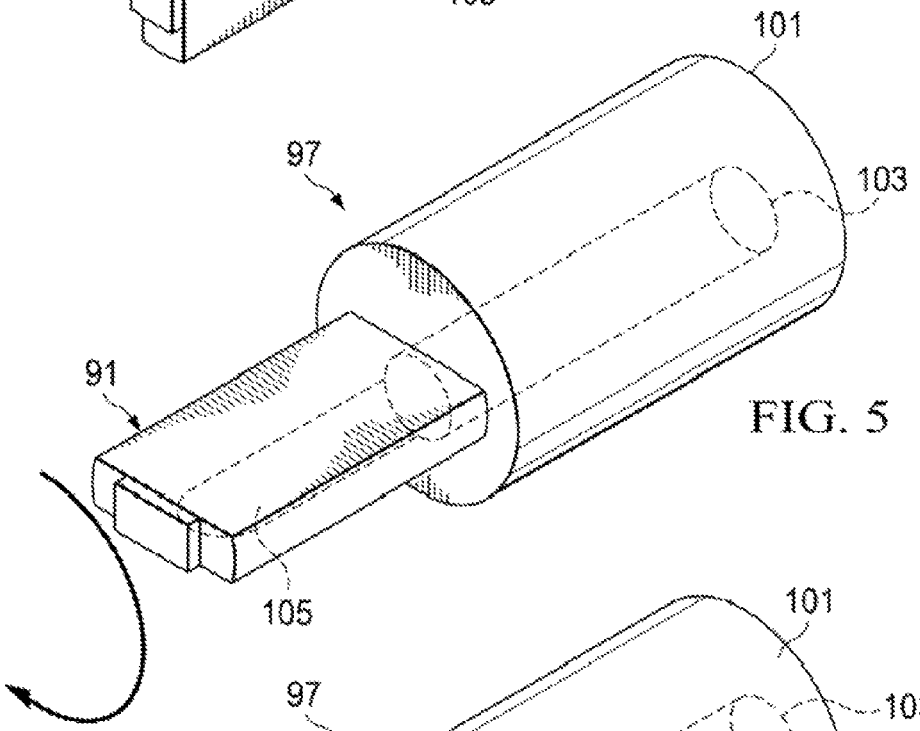
FIG. 5 is a perspective view of a diverter inserted into a subsea wellhead housing after rotation of the diverter according to an embodiment of the present invention.

Referring to FIGS. 4-5, in an exemplary configuration, the diverter 97 includes a main body 101, a passageway 103 extending through portions of the main body 101 along a main axis thereof to channel well fluid from within the wellhead housing 41, and a well fluid collection aperture 105 extending through at least a portion of the diverter 97 and connecting to the passageway 103 to provide a fluid channel to the passageway 103. The well fluid collection aperture 105 of the diverter 97 can he in the form of a downward facing recess that does not extend through the main body 101 of the diverter 97 so that when the diverter 97 is operably positioned and sealed within the wellhead housing 41, the well fluid collection aperture 105 channels well fluid into the passageway 103 in the main body 101 to divert well fluid from within the wellhead housing 41 to the external conduit 65. Correspondingly, outer surface portions of the diverter 97 can be shaped and material-wise configured to extend through and engage inner surface portions of an aperture 95 in the wellhead housing 31 to form a fluid-tight seal. Also or alternatively, inner surface portions of one or more of the apertures 93 extending through the casing strings 45, 47, 49, are sized to form a sealing relationship between the outer surface portions of the diverter 97 and the inner surface portions of the one or more of the apertures 93. A remote activation controller 79' operably connected to or integral with the emergency well fluid diversion assembly 63 can receive remote activation commands and can provide a remote activation signal to the casing strings penetrator 91 to cause the formation of the apertures 93 in the casing strings 45, 47, 49, and/or the well fluid diverter 97 to extend through the apertures 93 in the casing strings 45. 47, 49, and/or aperture 95 to divert well fluid from within the wellhead housing 31 to the external conduit 65.

Figure 6:
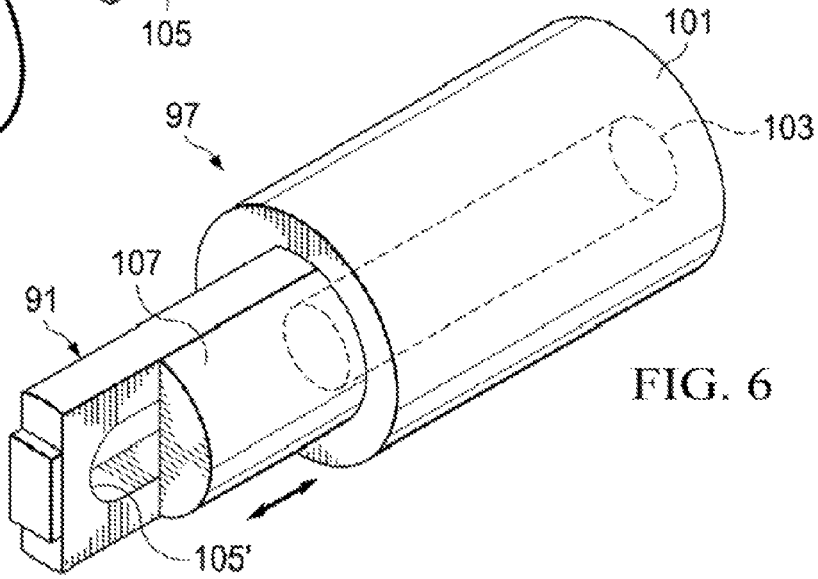
FIG. 6 is a perspective view of a diverter having a gate to close MT one side of a through aperture according to an embodiment of the present invention.
Figure 7:
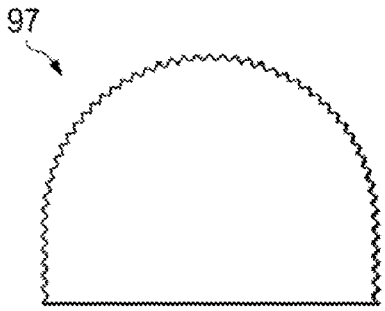
FIG. 7 is a sectional view of a cutting blade portion of a casing strings penetrator according to an embodiment of the present invention.
Figure 8:
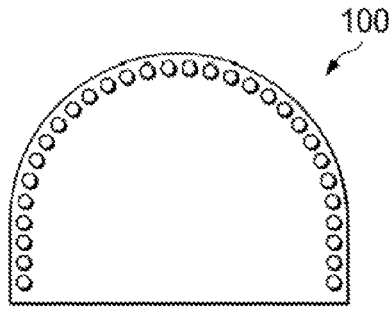
FIG. 8 is a sectional view of an electrical discharge machining cutting portion of a casing strings penetrator according to an embodiment of the present invention.
Figure 9:
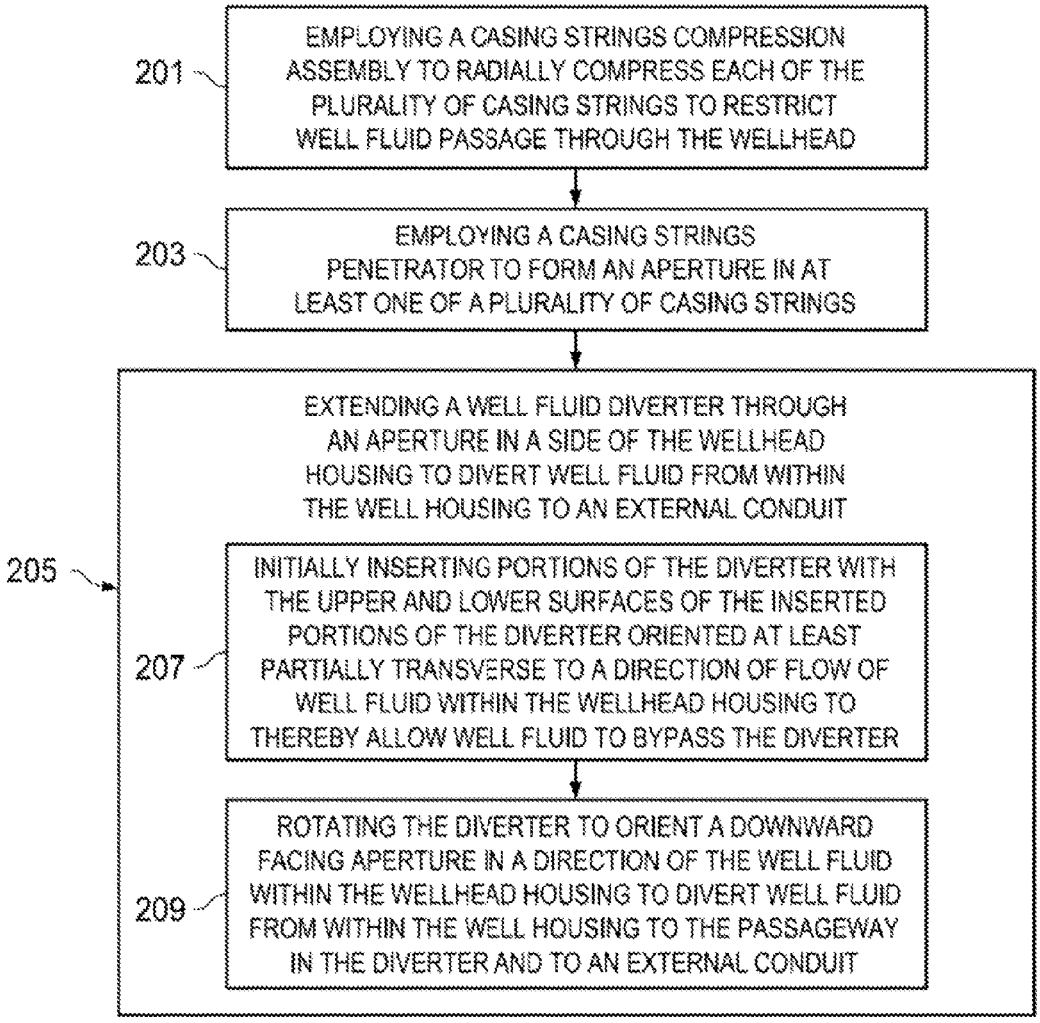
FIG. 9 is a schematic block diagram of a method to control a well according to an embodiment of the present invention.

FIG. 6 illustrates an alternate embodiment of the diverter 97 whereby the well fluid collection aperture 105' extends through the body of the diverter 97. In such configuration, the diverter 97 can include a gate 107 which can be employed to allow well fluid to bypass the diverter 97 or when actuated, can cause well fluid to be channeled into passageway 103.

Embodiments of the present invention also include methods to control a well 31. For example, referring to FIG. 9, a method according to an embodiment of the present invention can include employing a casing strings compression assembly 61 to radially compress each of the plurality of casing strings to restrict well fluid passage through portions of the wellhead housing 41 (block 201). The method can also include employing a casing strings penetrator 91 of an emergency well fluid diversion assembly 63 to form an aperture 93 in the casing strings 45, 47, 49 (block 203), and extending a well fluid diverter 97 through an aperture 95 in a side of the wellhead housing 41 and one or more of the apertures 93 cut by the penetrator 91 to divert well fluid from within the wellhead housing 41 to an external conduit 65 (block 205). As further shown in FIGS. 4-5, according to an exemplary embodiment of the method, insertion of the diverter 97 can be accomplished by initially inserting portions of the diverter 97 with the upper and lower surfaces of the inserted portions of the diverter 97 oriented at least partially transverse to a direction of flow of well fluid within the wellhead housing to thereby allow well fluid to bypass the diverter 97 (block 207), and rotating the diverter 97, e.g., 90°, to orient the downward facing aperture 105 in a direction of the well fluid within the wellhead housing 41 to divert well fluid from within the wellhead housing 41 to the passageway in the diverter 97 and to the external conduit 65 (block 209). The step of rotating the diverter 97 can include first sealingly engaging outer surface portions of the diverter 97 with inner surface portions of the aperture 93 in at least one of the casing strings 45, 47, 49, and orienting the downward facing aperture 105 in a direction of the well fluid within the wellhead housing 41 to divert well fluid from within the wellhead housing 41 to the passageway 103 in the diverter 97 and to the external conduit 65. As further shown in FIG. 6, if the aperture 105 is in the form of a through aperture 105', insertion of the diverter 97 can further include closing a gate 107 to establish fluid flow through the passageway 103 in the diverter 97.

Embodiments of the present invention provide several advantages. In the case of a subsea blowout, the only means of well control is currently the subsea blow out preventor (BOP). If the closure mechanisms of the BOP fail to work, there is not another means to stop or control the flow from the subsea well. This could result in the catastrophic and uncontrollable spillage of reservoir products into the ocean. The subsea wellhead emergency shut off/diversion apparatus 30 according to an embodiment of the present invention is a separate mechanism from the BOP that is capable of either shutting off or severely restricting the flow from a subsea blowout, or for diverting the flow of the well. The apparatus 30 may be run as part of the subsea wellhead, or run after the wellhead is installed, as with existing wells. Operation of the apparatus 30 can be performed, for example, through one of several means: (1) Utilization of an external system, such as an ROV, to actuate the shut off device by either torque, linear actuation, or pressure supplied by the ROV. This closure can pinch, shear, or penetrate any casing strings landed in the high pressure housing or wellhead system. The external system would generally supply the needed power and communications link to the apparatus 30. The ROV may engage the wellhead BOP device directly or from some distance from the well 31. (2) An in-situ system, integral to the shut-off device, can be utilized to actuate the shut off apparatus 30 to perform either torque, linear actuation, or other operations to effect well control. The in-situ system can supply the needed power and communications link, either wired or wireless, to the apparatus 30. Energy sources can include among others, mechanical, chemical, (e.g. batteries & explosives), or compressed fluids. (3) The activation of the apparatus 30 can be independent of the primary BOP control system or platform personnel. The activation system can, however, be activated by any of the above means (dual or multiple activation capable). The activation of the apparatus 30 can be, at a minimum, operable from a remote platform, control ship, or land based operation that is independent of the platform from which the drilling operations are being conducted, In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification.

The invention claimed is:

1. A wellhead-based control apparatus to control a well, the apparatus comprising:

a wellhead housing configures to hang a plurality of casing strings, the wellhead housing including a bore adapted to receive the plurality of casing strings extending therethrough, each of the plurality of casing strings having a different diameter than each other of the plurality of casing strings; and an emergency well fluid shutoff assembly comprising:

a casing strings compression assembly positioned to radially compress each of the plurality of casing strings, and a casing strings compression actuator operably coupled to the casing strings compression assembly to actuate the casing strings compression assembly.

wherein a blowout preventer is connected to the wellhead housing:

wherein substantial portions of the emergency well fluid shutoff assembly including the casing strings compression assembly are located below and separate from the blowout preventer; and wherein compression is performed at approximately a same coaxial location for each of the plurality of casing strings.

2. A wellhead-based control apparatus as defined in claim 1, further comprising:

a remote activation controller connected to or integral with the emergency well fluid shutoff assembly to receive remote activation commands and to provide a remote activation signal to the casing strings compression actuator to cause actuation, of the casing strings compression assembly.

3. A wellhead-based control apparatus to control a well, the apparatus comprising:

wellhead housing configured to hang a plurality of casing strings, the wellhead housing including a bore adapted to receive the plurality of casing strings extending therethrough, each of the plurality of casing strings having a different diameter than each other of the plurality of casing strings; and an emergency well fluid shutoff assembly comprising:

a casing strings compression assembly positioned to radially compress each of the plurality of casing strings, the casing strings compression assembly including a pair of opposing compression rams positioned to extend radially toward a center of the bore of the wellhead housing to apply a compressing force to each of the plurality of casing strings, the casing strings compression assembly located below and separate from any blowout preventer stack or assembly, and a casing strings compression actuator operably coupled to the casing strings compression assembly to actuate the casing strings compression assembly.

4. A wellhead-based control apparatus: as defined in claim 3, wherein each of the pair of opposing compression rams includes a hydraulic piston connected to a portion of the wellhead housing to apply the compressing force to the plurality of casing strings; and wherein the casing strings compression actuator includes a hydraulic source comprising one or more of the following: a hydraulic accumulator storing pressurized hydraulic fluid and a hydraulic pump assembly having a hydraulic pump, a motor positioned to drive the hydraulic pump, and a hydraulic fluid reservoir.

5. A wellhead-based control apparatus as defined in claim 3, wherein each of the pair of opposing compression rams includes a linear actuator connected to a portion of the wellhead housing that when rotated extends portions of the compression rams toward a center of the bore of the wellhead housing to apply the compressing force to the plurality of casing strings; and wherein the casing strings compression actuator includes at least one electric motor positioned to rotate the linear actuators and an electrical power source.

6. A wellhead-based control apparatus as defined in claim 3, wherein the casing strings compression actuator includes at least one explosive charge positioned to cause each of the opposing compression rams to simultaneously move radially toward a center of the bore of the wellhead housing to apply the compressing force to the plurality of casing strings.

7. A wellhead-based control apparatus to control a well, the apparatus comprising:

a wellhead housing configured to hang a plurality of casing strings, the wellhead housing including, a bore adapted to receive the plurality of casing strings extending therethrough, each of the plurality of casing strings having a different diameter than each other of the plurality of casing strings; and an emergency well fluid diversion assembly including:

a casing strings penetrator positioned to form an aperture in each of the plurality of casing strings defining a plurality of apertures, and a well fluid diverter positioned to extend through the plurality of apertures to divert well fluid from flowing within the wellhead housing to an external conduit to thereby release fluid pressure of well fluid flowing within the wellhead housing in a controlled manner, wherein portions of the diverter to be extended through the plurality of apertures include an upper surface and lower surface having an axis extending therebetween, a distance therebetween defining as thickness of the portions of the diverter to be extended through the plurality of apertures, and a first and as second sidewall, a distance therebetween defining a width of the portions of the diverter to be extended through the plurality of apertures, and wherein the thickness of portions of the diverter to be inserted within the plurality of apertures is substantially smaller than the width of the portions of the diverter to be inserted so that when the diverter is inserted through the aperture in at least one of the plurality of casing strings with the axis extending between the upper and the lower surfaces oriented substantially transverse to a main axis of the wellhead, well fluid flows pest the diverter to portions of the wellhead housing located above the plurality of apertures, and when the lower surface is oriented to face in a direction of the well fluid flowing within the wellhead housing, substantial portions of the well fluid is diverted from flowing within the wellhead housing and to the external conduit.

8. A wellhead-based control apparatus as defined in claim 7, wherein the penetrator is positioned to form the aperture in each of the plurality of casing strings at approximately a same coaxial location for each of the plurality of casing strings.

9. A -wellhead-based control apparatus as defined in claim 7, wherein the penetrator comprises one or more of the following:

a cutting blade assembly positioned to cut an aperture through the wellhead housing and the plurality of casing strings, an electrical discharge cutting assembly positioned to cut an aperture through the wellhead housing and the plurality of casing strings, a chemical milling assembly positioned to cut an aperture through the wellhead housing and the plurality of casing strings, and an explosive discharge cutting assembly including a explosive charge operably connected to a cutting torpedo to cut an aperture through the wellhead housing and the plurality of casing strings, wherein the diverter further extends through an aperture in the wellhead housing; and wherein inner surface portions of one or more of the apertures extending through the plurality of casing strings and the wellhead housing and outer surface portions of the diverter are sized to form a sealing relationship between the outer surface portions of the diverter and the inner surface portions of the one or more of the apertures.

10. A wellhead-based control apparatus as defined in claim 7, wherein the diverter includes;

a main body;

a passageway extending through portions of the main body along a main axis thereof to channel well fluid from within the wellhead housing wherein the diverter is sealingly engaged within one or more of the apertures cut through a corresponding one or more of the plurality of casing strings; and a well fluid collection aperture extending through at least a portion of the diverter and connecting to the passageway to provide a fluid channel to the passageway.

11. A wellhead-based control apparatus as defined in claim 10, wherein the well fluid collection aperture of the diverter comprises a downward facing recess that does not extend through the main body of the diverter so that when the diverter is operably positioned and sealed within the wellhead housing, the well fluid collection aperture channels well fluid into the passageway to divert well fluid from within the wellhead housing to the external conduit.

12. A wellhead-based control apparatus as defined in claim 10, wherein the well fluid collection aperture further extends through the main body of the diverter to provide a fluid bypass for well fluid within the wellhead housing during penetration of the diverter into the one or more of the apertures cut through the wellhead housing and cut through each of the plurality of casing strings; and wherein the diverter includes a gate connected to upper surface portions of the diverter and slidingly positioned so that when actuated, the gate closes a portion of the well fluid collection aperture to divert well fluid entering the well fluid collection aperture into the passageway extending through portions of the main body of the diverter to thereby divert well fluid from within the wellhead housing to the external conduit.

13. A wellhead-based control apparatus as defined in claim 10, further comprising:

an emergency well fluid shutoff assembly integral with the wellhead housing and including a casing strings compression assembly positioned to radially compress each of the plurality of casing strings, and a casing strings compression actuator operably coupled to the casing strings compression assembly to actuate the casing strings compression assembly, the emergency well fluid shutoff assembly configured to prevent well fluid passage through portions of the wellhead located above the emergency well fluid diversion assembly so that when actuated, well fluid is diverted from within the wellhead housing to the external conduit.

14. A wellhead-based control apparatus as defined in claim 7, further comprising:

a remote activation controller connected to or integral with the emergency well fluid diversion assembly to receive remote activation commands and to provide a remote activation signal to one or more of the following: the casing strings penetrator to cause the formation of the aperture in each of the plurality of casing strings, and the well fluid diverter to extend through the aperture in each of the plurality of casing strings to divert well fluid from within the wellhead housing to the external conduit.

15. A wellhead-based control apparatus to control a well, the apparatus comprising:

a wellhead housing including a bore adapted to receive a plurality of casing strings extending therethrough, each of the plurality of casing strings having a different diameter than each other of the plurality of casing strings;

an emergency well fluid diversion assembly including: a casing strings penetrator positioned to form an aperture in each of the plurality of casing strings defining a plurality of apertures, and a well fluid diverter positioned to extend through the aperture in each of the plurality of casing strings to divert well fluid from flowing within the wellhead housing, to an external conduit to thereby release fluid pressure of well fluid flowing within the wellhead housing in a controlled manner, wherein portions of the diverter to be extended through the plurality of apertures include an upper surface and lower surface having an axis extending therebetween, a distance therebetween defining a thickness of the portions of the diverter to be extended through the plurality of apertures, and a first and a second sidewall, a distance therebetween defining a width of the portions of the diverter to be extended through the plurality of apertures, and wherein the thickness of portions of the diverter to be inserted within the plurality of apertures is substantially smaller than the width of the portions of the diverter to be inserted so that when the diverter is inserted through the aperture in at least one of the plurality of casing strings with the axis extending between the upper and the lower surfaces oriented substantially transverse to a main axis of the wellhead, well fluid flows past the diverter to portions of the wellhead housing located above the plurality of apertures, and when the lower surface is oriented to face in a direction of the well fluid flowing within the wellhead housing, substantial portions of the well fluid is diverted from flowing within the wellhead housing and to the external conduit; and an emergency well fluid shutoff assembly including: a casing strings compression assembly positioned to radially compress each of the plurality of casing strings, and a casing strings compression actuator operably coupled to the casing strings compression assembly to actuate the casing strings compression assembly, the emergency well fluid shutoff assembly configured to reduce well fluid flow of well fluids flowing through portions of the wellhead located above the emergency well fluid diversion assembly and above the casing strings compression assembly so that when actuated, well fluid is diverted from within the wellhead housing to the external conduit.

16. wellhead-based control apparatus as defined in claim 15, wherein the penetrator is positioned to form the aperture in each of the plurality of casing strings at approximately a same coaxial location for each of the plurality of casing strings;

wherein the diverter further extends through an aperture in the wellhead housing; and wherein inner surface portions of one or more of the apertures extending through the plurality of casing strings and the wellhead housing and outer surface portions of the diverter are sized to form a sealing relationship between the outer surface portions of the diverter and the tuner surface portions of the one or more of the apertures.

17. A wellhead-based control apparatus as defined in claim 15 wherein the diverter includes:

a main body, a passageway extending through portions of the main body along a main axis thereof to channel well fluid from within the wellhead housing wherein the diverter is sealingly engaged within one or more of the apertures cut through a corresponding one or more of the plurality of casing strings, and a well fluid collection aperture extending through at least a portion each of the diverter and connecting to the passageway to provide a fluid channel to the passageway; and wherein the wellhead-based control apparatus further comprises the external conduit operably coupled to the diverter to receive well fluid diverted from within the wellhead housing.

18. A wellhead-based control apparatus as defined in claim 15, wherein compression is performed at approximately a same coaxial location for each of the plurality of casing strings;

wherein the casing strings compression assembly includes a pair of opposing of compression rams positioned to extend radially toward a center of the bore of the wellhead housing to apply a compressing force to each of the plurality of casing strings; and wherein the compression of the plurality of casing strings achieves at least approximately a 95 percent reduction in fluid flow of the well fluids flowing through the wellhead housing to the blow out preventer.

19. A method to control a well, the method comprising the steps of:

employing a casing strings penetrator of an emergency well fluid diversion assembly to form an aperture in at least one of a plurality of casing strings, each of the plurality of casing strings coaxially located within and extending through portions of a wellhead housing, each of the plurality of casing strings having a different diameter than each other of the plurality of casing strings; and extending a well fluid diverter through an aperture in a side of the wellhead housing and the aperture in the at feast one of the plurality of casing strings to divert well fluid from flowing within the wellhead housing to an external conduit to thereby release fluid pressure of well fluid within the wellhead housing in a controlled manner;

wherein the diverter includes: a main, body, a passageway extending through portions of the main body along a main axis thereof to channel well fluid from flowing within the wellhead housing, and a well fluid collection aperture extending through at least a portion of the diverter and connecting to the passageway to provide a fluid channel to the passageway;

wherein the well fluid collection aperture of the diverter comprises a downward facing recess that does not extend through the main body of the diverter so that when the diverter is operably positioned and sealed within the wellhead housing, the well fluid collection aperture faces downward within the wellhead housing and channels well fluid into the passageway to divert well fluid from within the wellhead housing to the external conduit;

wherein portions of the diverter to be inserted within the aperture in the wellhead housing include:

an upper surface and lower surface, a distance therebetween defining a thickness of the portions of the diverter to be inserted within the wellhead housing, and a first and a second sidewall, a distance therebetween defining a width of the portions of the diverter to be inserted within the wellhead housing;

wherein the thickness of portions of the diverter to be inserted within the wellhead housing is substantially smaller than the width of the portions of the diverter to be inserted so that when the diverter is inserted through the aperture in the wellhead housing and the aperture in at least one of the plurality of casing strings with the upper and lower surfaces oriented substantially transverse to a main axis of the wellhead, well fluid flows past the diverter to portions of the wellhead housing located above the aperture in the wellhead housing; and wherein the step of extending a well fluid diverter through the aperture in the side of the wellhead housing and the aperture in the at least one of the plurality of casing strings includes initially inserting portions of the diverter with the upper and lower surfaces of the inserted portions of the diverter oriented at least partially transverse to a direction of flow of well fluid within the wellhead housing to thereby allow well fluid to bypass the diverter.

20. A method as defined in claim 19, wherein the penetrator is positioned to form the aperture in each of the plurality of casing strings at approximately a same coaxial location for each of the plurality of casing strings.

21. A method as defined in claim 19, wherein inner surface portions of the aperture in a side of the wellhead housing and outer surface portions of the diverter are sized to form a sealing relationship between the outer surface portions of the diverter and the inner surface portions of the aperture in the wellhead housing; and wherein the step of extending a well fluid diverter through an aperture in a side of the wellhead housing includes sealingly engaging outer surface portions of the diverter extending into the aperture in a side of the wellhead housing with inner surface portions of the aperture in a side of the wellhead housing to divert well fluid from within the wellhead housing to the external conduit.

22. A method as defined in claim 19, wherein inner surface portions of one or more of the apertures extending through one or more of plurality of casing strings and outer surface portions of the diverter are sized to form a sealing relationship between outer surface portions of the diverter and the inner surface portions of the one or more of the apertures to divert well fluid from within the wellhead housing to the external conduit.

23. A method as defined in Claim 19, wherein inner surface portions of an aperture in the wellhead housing and outer surface portions of the diverter are sized to form a sealing relationship between the outer surface portions of the diverter and the inner surface portions of the aperture in the wellhead housing;

wherein the step of extending a well fluid diverter through the aperture in the side of the wellhead housing includes sealingly engaging outer surface portions of the diverter extending into the aperture in the wellhead housing with inner surface portions of the aperture in the wellhead housing; and wherein the method farther comprises the step of rotating the diverter to orient the downward facing aperture in a direction of the well fluid within the wellhead housing to divert well fluid from within the wellhead housing to the passageway in the diverter and to the external conduit.

24. A method as defined in claim 19, further comprising the step of rotating the diverter, the step of rotating the diverter including:

sealingly engaging outer surface portions of the diverter with inner surface portions of the aperture in at least one of the plurality of casing strings; and orienting the downward facing aperture in a direction of the well fluid within the wellhead housing to divert well fluid from within the wellhead housing to the passageway in the diverter and to the external conduit.

25. A method as defined in claim 19, further comprising the step of:

employing a casing strings compression assembly of an emergency well fluid shutoff assembly to radially compress each of the plurality of casing strings to restrict well fluid passage through portions of the wellhead located above the emergency well fluid diversion assembly so that when actuated, well fluid is diverted from within the wellhead housing to the external conduit through the well fluid diversion assembly.

26. A method as defined in claim 25, wherein the casing strings compression assembly includes a pair of opposing compression rams positioned to extend radially toward a center of the bore of the wellhead housing to apply a compressing force to each of the plurality of casing strings; and wherein compression is performed at approximately a same coaxial location for each of the plurality of casing strings.

* * * * *